US005906284A

United States Patent [19]

Hammerstrom et al.

[11] Patent Number: 5,906,284

[45] Date of Patent: May 25, 1999

[54] MULTI-WORKSTATION DEVICE

[75] Inventors: Kenneth O. Hammerstrom, Riceville, Iowa; James Whiteford, Hutchinson, Kans.

[73] Assignee: Kenneth Hammerstrom, Riceville, Iowa

[21] Appl. No.: 08/972,788

[22] Filed: Nov. 18, 1997

[51] Int. Cl.[6] ..... A47F 5/00

[52] U.S. Cl. ..... 211/205; 211/133.4; 211/107; 248/125.7; 248/122.1; 248/125.1

[58] Field of Search ..... 211/205, 207, 211/208, 163, 70.6, 26, 131.1, 133.4, 107, 86.01; 248/122.1, 125.9, 415, 125.1, 125.7

[56] References Cited

U.S. PATENT DOCUMENTS

| | | | |
|---|---|---|---|
| 1,382,505 | 6/1921 | Hargey | 211/86.01 X |
| 1,589,137 | 6/1926 | Finch . | |
| 2,290,410 | 7/1942 | Dawson | 248/125.7 X |
| 2,937,381 | 5/1960 | Manas | 248/122.1 X |
| 3,089,028 | 5/1963 | Klampferer | 248/122.1 |
| 4,299,370 | 11/1981 | Monticelli et al. . | |
| 5,038,819 | 8/1991 | Sutphen . | |
| 5,126,928 | 6/1992 | Hughes . | |
| 5,178,286 | 1/1993 | Allison | 211/205 X |
| 5,275,364 | 1/1994 | Burger et al. . | |
| 5,284,255 | 2/1994 | Foster et al. . | |
| 5,318,175 | 6/1994 | Stevens | 211/107 |
| 5,374,019 | 12/1994 | Fischer | 248/125.7 |
| 5,655,741 | 8/1997 | Watkins | 248/125.9 X |
| 5,681,017 | 10/1997 | Clausen | 248/125.1 |
| 5,735,413 | 4/1998 | Allen | 211/133.4 |
| 5,746,334 | 5/1998 | Brandenberg | 211/205 |

*Primary Examiner*—Robert W. Gibson, Jr.
*Attorney, Agent, or Firm*—Stinson, Mag & Fizzell, P.C.

[57] ABSTRACT

A multi-workstation device is provided which includes a vertically-oriented pole and a workstation assembly mounted thereto. The workstation assembly includes a sleeve mounted around the pole, a plurality of arms affixed to and extending radially outward from the sleeve, and a plurality of horizontally-oriented work surfaces affixed to the arms. In a preferred embodiment, the workstation assembly is vertically adjustable and circumferentially rotatable relative to the pole, and the device also includes a vertical lock and a circumferential lock for locking the workstation assembly to the pole in a desired vertical and circumferential position. The device optionally also includes a seat assembly or a workbench assembly, a light assembly, a winch assembly, a power supply, and an air supply.

15 Claims, 6 Drawing Sheets

Fig. 9
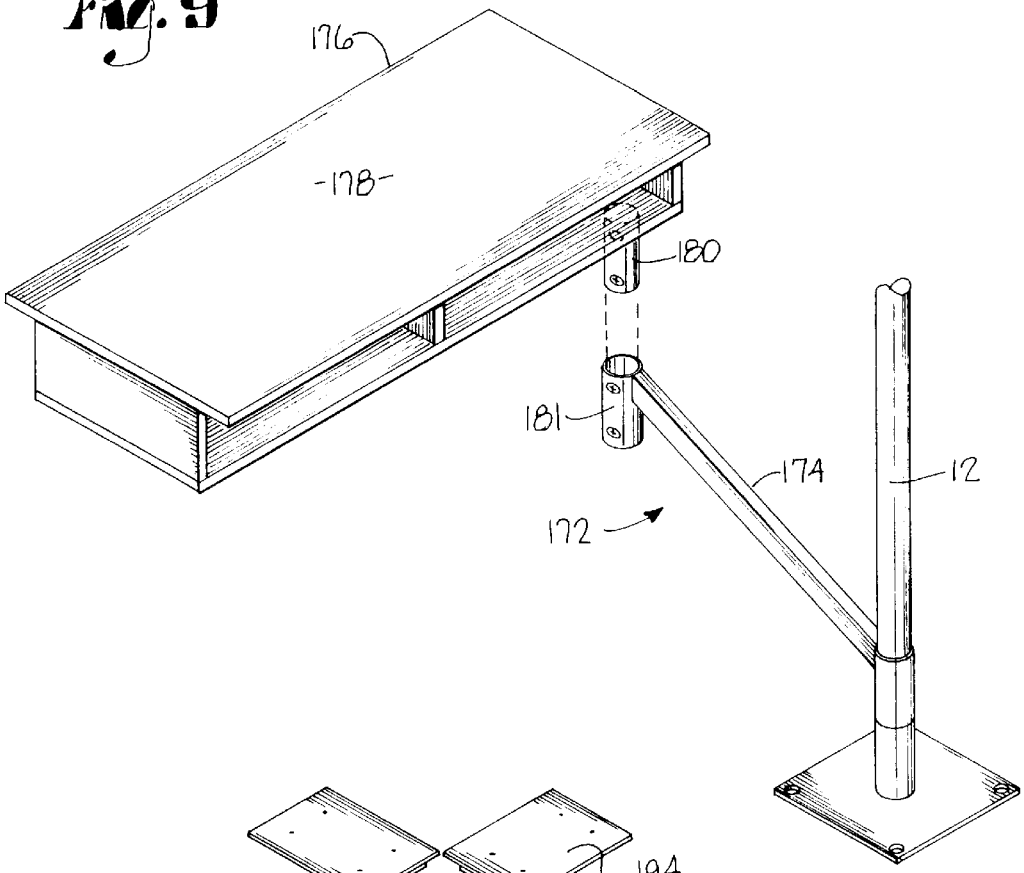
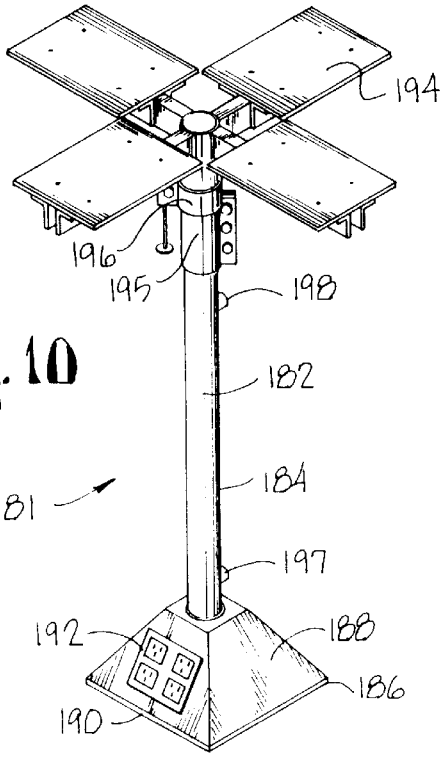
Fig. 10

MULTI-WORKSTATION DEVICE

BACKGROUND OF THE INVENTION

1. Field of the Invention

The present invention relates to multi-workstation devices and, particularly, to multi-workstation devices for mounting a plurality of tools.

2. Background Information

Many tools, such as welders, grinders, drill presses, jigsaws, bearing presses, buffers, and miter saws, are designed to be mounted to a horizontally-oriented work surface. In most shop environments, the work surface used to mount these tools is a conventional workbench. In the shop, it is common that a worker uses a variety of different tools on a regular basis, and, thus, the worker often mounts the tools on a number of workbenches so as to make the tools readily accessible.

A problem that frequently arises, however, is that the tools mounted on existing workbenches utilize all of the available work space in the shop, and leave the worker with no space to perform other tasks. Under these circumstances, a worker can either add additional workbenches, or, alternately, limit the number of tools mounted to existing workbenches. If the shop area is small, there may not be enough area to accommodate the number of workbenches required to mount all of the necessary tools, and, as a result, the worker has no choice but to limit the number of tools mounted to existing workbenches. As such, many tools must be stored out of the way, and the worker must mount the tools on the workbenches on an as-needed basis.

Thus, it can be seen that there is a need for a device which can mount a plurality of tools in a small amount of shop area.

Therefore, an objective of the present invention is to provide a device which can mount a plurality of tools in a small amount of shop area. Another objective is to provide a device which includes a vertically-oriented pole and a plurality of horizontally-oriented work surfaces mounted thereto for providing rigid surfaces on which to mount the tools. A further objective is to provide a device wherein the work surfaces are vertically adjustable and circumferentially rotatable relative to the pole, and wherein the device also includes a vertical lock and a circumferential lock for locking the work surfaces to the pole in a desired vertical and circumferential position.

SUMMARY OF THE INVENTION

These and other objectives are met by the multi-workstation device of the present invention.

The multi-workstation device includes a vertically-oriented pole having an upper end and a lower end. The pole can be mounted between the floor and ceiling of a shop and secured at its upper and lower ends, or, alternately, mounted to the floor of a shop and secured only at its lower end. The pole can optionally also be mounted on a movable base and secured only at its lower end.

The multi-workstation device also includes a workstation assembly mounted to the pole. The workstation assembly includes a sleeve mounted around the pole, a plurality of arms affixed to and extending radially outward from the sleeve, and a plurality of horizontally-oriented work surfaces affixed to the arms for providing rigid surfaces on which to mount the tools.

In a preferred embodiment, the workstation assembly is vertically adjustable and circumferentially rotatable relative to the pole. In this embodiment, the multi-workstation device also includes a vertical lock and a circumferential lock so that a user can lock the workstation assembly to the pole in a desired vertical and circumferential position.

The vertical lock includes a sleeve which is mounted around the pole and vertically adjustable relative to the pole. In use, the user can mount the vertical lock to the pole at a position below the sleeve of the workstation assembly so that the vertical lock supports the sleeve of the workstation assembly in a fixed vertical position. As such, the user can mount the workstation assembly to the pole in any desired vertical position.

The circumferential lock includes a flexible strap wrapped around the sleeve of the workstation assembly. A lever is operably connected to the strap and is movable between an open and closed position so as to unlock and lock the sleeve of the workstation assembly to the pole. In use, the user can open the circumferential lock so as to unlock the sleeve from the pole, thereby allowing the user to rotate the workstation assembly to a desired circumferential position. The user can also close the circumferential lock so as to lock the sleeve to the pole in the desired circumferential position.

The multi-workstation device optionally also includes a seat assembly for providing a seat for the user or a workbench assembly for providing additional work space for the user. The device may further include a light assembly for providing a light for the user, a winch assembly for assisting the user in lifting heavy objects off the floor and onto the work surfaces, a power supply for providing electrical power to the electrical tools, and an air supply for providing air to the pneumatic tools.

The present invention will be better understood from the following description of the invention, read in connection with the drawings as hereinafter described.

DESCRIPTION OF THE DRAWINGS

FIG. 9 is an exploded perspective view of the workbench assembly of the multi-workstation device of the present invention.

FIG. 10 is a perspective view of a second example of the multi-workstation device of the present invention.

DESCRIPTION OF THE INVENTION

The present invention is a multi-workstation device for mounting a plurality of objects in a small amount of area.

The multi-workstation device includes a vertically-oriented pole and a workstation assembly mounted thereto. The workstation assembly includes a plurality of horizontally-oriented work surfaces for providing rigid surfaces on which to mount the objects. Preferably, the workstation assembly is vertically adjustable and circumferentially rotatable relative to the pole, and the device also includes a vertical lock and a circumferential lock so that a user can lock the workstation assembly to the pole in a desired vertical and circumferential position.

Although the device will hereinafter be described in conjunction with the mounting of tools, it is to be understood that the device can also be used to mount any type of object which is ordinarily mounted on a horizontally-oriented work surface.

FIRST EXAMPLE

Figure 1:
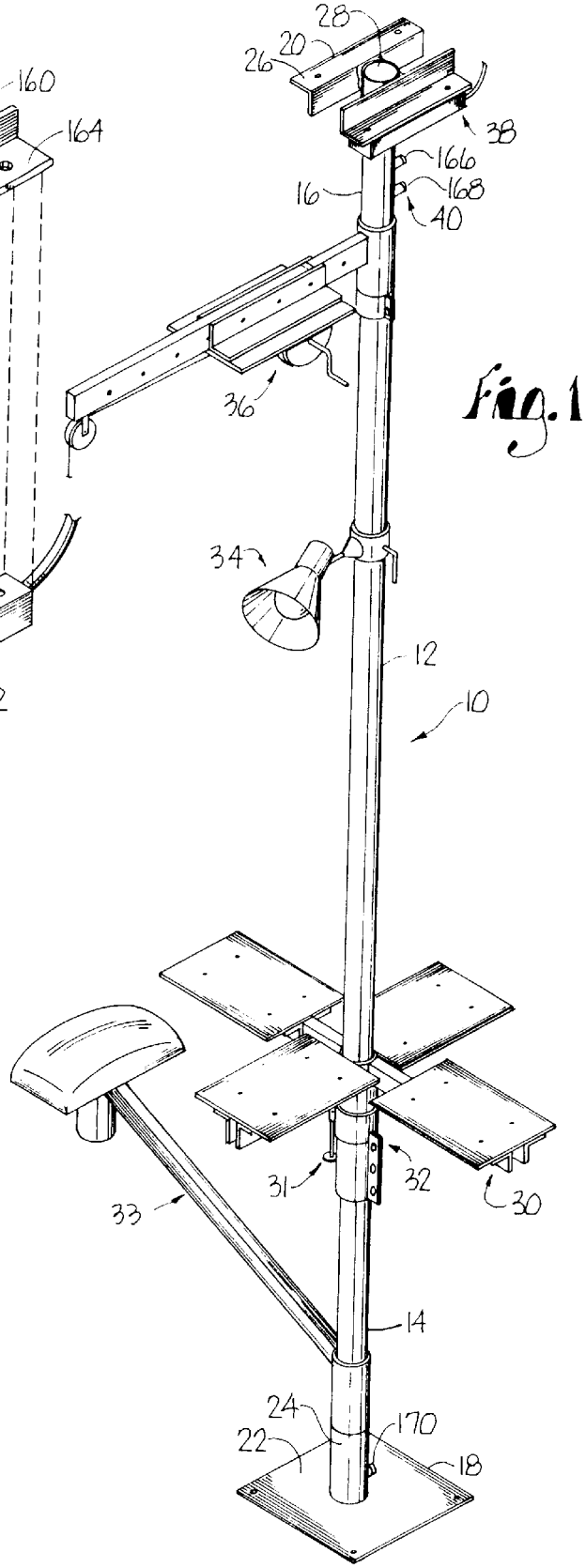
FIG. 1 is a perspective view of a first example of the multi-workstation device of the present invention.

Referring to FIG. 1, a first example of the multi-workstation device of the present invention is illustrated.

Multi-workstation device 10 includes vertically-oriented pole 12 having lower end 14 and upper end 16 extending between two opposed horizontal surfaces, such as a floor and a ceiling of a shop. Pole 12 is preferably hollow and made of a rigid material, such as metal or other materials known in the art.

To rigidly secure pole 12 at lower and upper ends 14 and 16, floor mount 18 and ceiling mount 20 are provided.

Floor mount 18 includes base plate 22 bolted or otherwise rigidly secured to the floor, and upwardly extending sleeve 24 centrally disposed on the top of base plate 22 and welded or otherwise affixed thereto. Sleeve 24 has an inside diameter that is slightly larger than the outside diameter of pole 12 so that lower end 14 can be inserted into sleeve 24 and bolted or otherwise secured in place.

Figure 2:
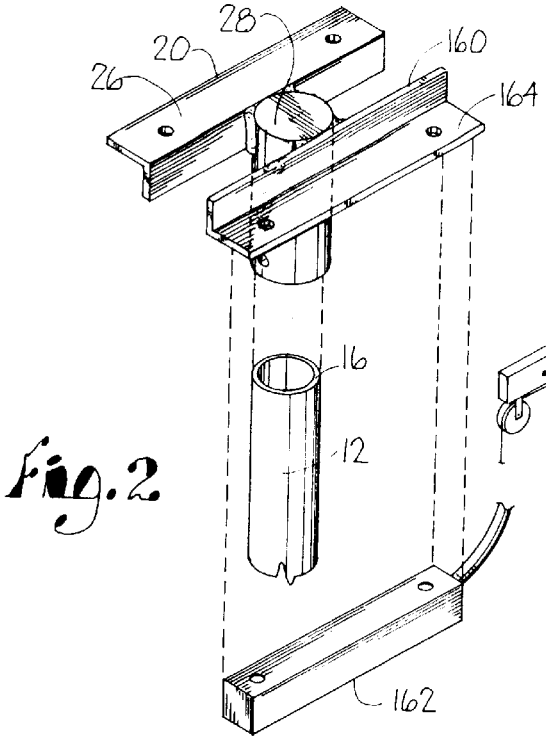
FIG. 2 is an exploded perspective view of the ceiling mount and power supply assembly of the multi-workstation device of FIG. 1.

Referring to FIG. 2, ceiling mount 20 includes angle iron 26 having a horizontally oriented member bolted or otherwise rigidly secured to the ceiling, and a vertically oriented member at a right angle thereto. The center portion of the vertically oriented member is welded or otherwise affixed to the sidewall of sleeve 28. Sleeve 28 has an inside diameter that is slightly larger than the outside diameter of pole 12 so that upper end 16 can be inserted into sleeve 28 and bolted or otherwise secured in place.

Although the first example has been illustrated as including a single pole section having a fixed length, it is well known in the art that the pole could also be formed of more than one pole section in which the sections are telescopingly connected so that a user can selectively adjust the pole length to any desired height.

Referring to FIG. 1, multi-workstation device 10 also includes workstation assembly 30 for providing rigid surfaces on which to mount the tools, vertical lock 31 for locking workstation assembly 30 to pole 12 in a fixed vertical position, and circumferential lock 32 for locking workstation assembly 30 to pole 12 in a fixed circumferential position. The device optionally also includes seat assembly 33 for providing a seat for the user, light assembly 34 for providing a light for the user, winch assembly 36 for assisting the user in lifting heavy objects off the floor and onto workstation assembly 30, power supply assembly 38 for providing electrical power to the electrical tools, and air supply assembly 40 for providing air to the pneumatic tools. All of these features will be described in greater detail hereinbelow.

Workstation Assembly

Figure 3:
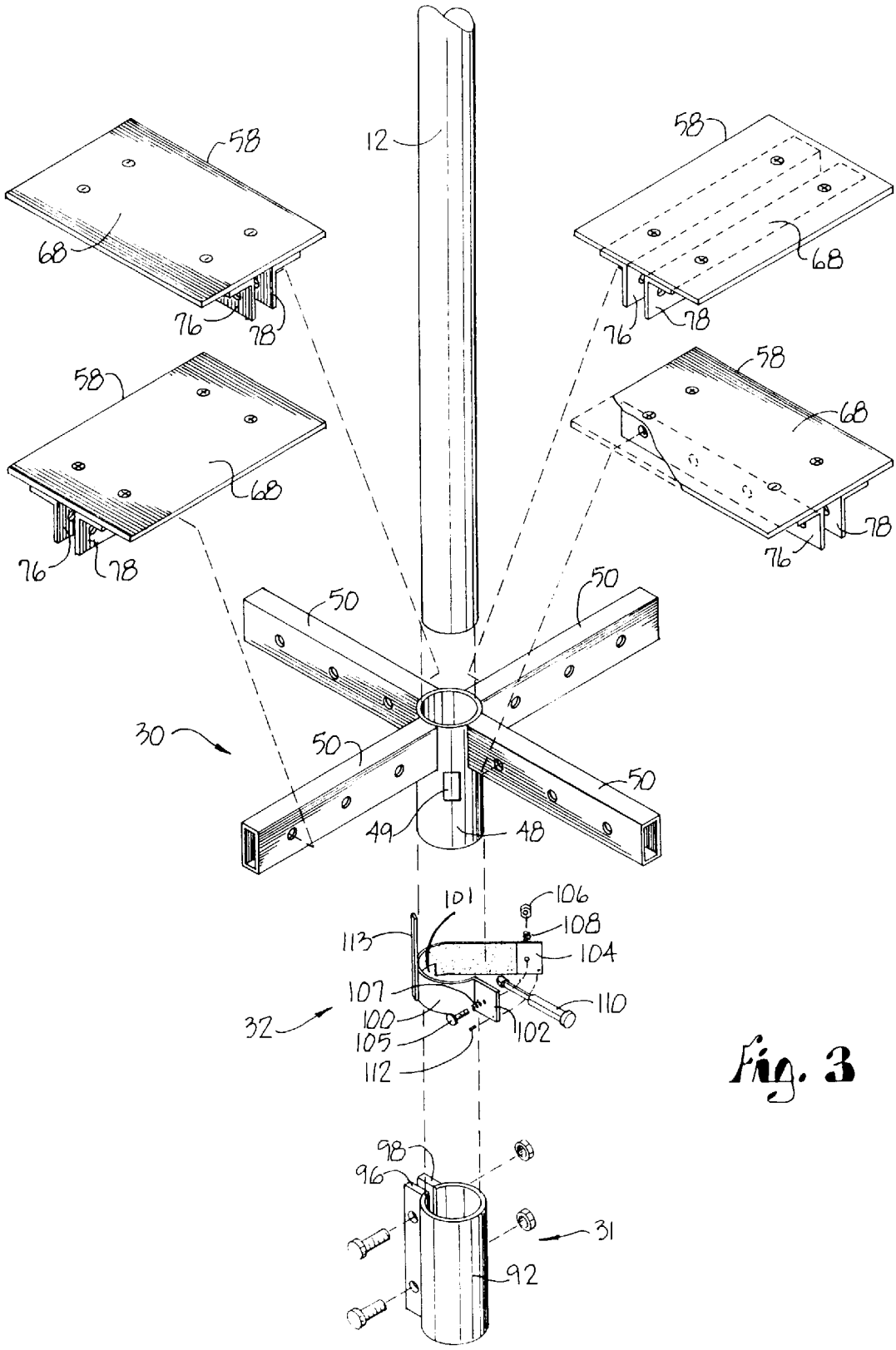
FIG. 3 is an exploded perspective view of the workstation assembly of the multi-workstation device of FIG. 1.

Referring to FIG. 3, workstation assembly 30 includes sleeve 48, arms 50 affixed to and extending radially outward from sleeve 48, and work surfaces 58 affixed to arms 50. Work surfaces 58 provide rigid surfaces on which to mount the tools, which, as is known in the art, can be bolted, clamped, or otherwise suitably fastened to work surfaces 58.

In the illustrated example, sleeve 48 has an inside diameter that is slightly larger than the outside diameter of pole 12 so that sleeve 48 can be mounted around pole 12 and movable to any desired vertical and circumferential position. Sleeve 48 also includes tab 49 welded or otherwise affixed to the sidewall thereof for limiting the circumferential rotation of workstation assembly 30, which will be described in greater detail hereinbelow.

Arms 50 include elongated tubes spaced 90° apart about the circumference of sleeve 48 and have one end welded or otherwise attached thereto. Although four arms have been illustrated, workstation assembly 30 could include any number of arms, preferably ranging from as few as two arms spaced 180° apart about the circumference of sleeve 48, to as many as six arms spaced 60° apart about the circumference of sleeve 48. Also, arms 50 could include extensions attached to the free ends thereof for extending the distance between work surfaces 58 and pole 12.

Work surfaces 58 include horizontally-oriented plates 68 bolted or otherwise connected to two spaced angle irons 76 and 78. Each angle iron consists of a horizontally oriented member and a vertically oriented member at a right angle thereto. The horizontally oriented members are bolted or otherwise connected to the bottom of plates 68, and the vertically oriented members are bolted or otherwise connected to the sides of arms 50.

Vertical and Circumferential Locks

As stated above, in the illustrated example, workstation assembly 30 is mounted to pole 12 such that sleeve 48 is vertically adjustable and circumferentially rotatable relative to pole 12. Therefore, vertical lock 31 and circumferential lock 32 are provided so that a user can lock workstation assembly 30 to pole 12 in a desired vertical and circumferential position.

Vertical lock 31 includes sleeve 92 having a vertical opening cut along the entire length of the sidewall thereof and first flange 96 and second flange 98 extending outwardly therefrom. Sleeve 92 has an inside diameter that is slightly larger than the outside diameter of pole 12 so that sleeve 92 can be mounted around pole 12. First and second flanges 96 and 98 can be bolted or otherwise fastened together to fixedly mount sleeve 92 to pole 12. Sleeve 92 has an outside diameter that is substantially the same as the outside diameter of sleeve 48 so that sleeve 92 can support sleeve 48 in a fixed vertical position.

In use, a user can fixedly mount vertical lock 31 to pole 12 at a position below sleeve 48 such that the top edge of sleeve 92 abuts the bottom edge of sleeve 48, and thereby supports sleeve 48 in a fixed vertical position. The user can also reposition vertical lock 31 anywhere along pole 12 so as to adjust the vertical position of sleeve 48 to any desired vertical height. As such, workstation assembly 30 can be moved to any desired vertical position.

Circumferential lock 32 includes flexible strap 100 wrapped around the bottom portion of sleeve 48 and the top portion of sleeve 92. Strap 100 has notch 101 cut along the sidewall thereof such that notch 101 is positioned over flanges 96 and 98 when circumferential lock 32 is wrapped around vertical lock 31. Circumferential lock 32 also includes first flange 102 and second flange 104 extending outwardly therefrom. Flanges 102 and 104 are connected by bolt 105 and nut 106 so as to fixedly mount strap 100 to the bottom portion of sleeve 48 and the top portion of sleeve 92.

First bias spring 107 is mounted to bolt 105 and seated between the bolt head and first flange 102, and second bias spring 108 is mounted to bolt 105 and seated between nut 106 and second flange 104. Lever 110 is pivotally mounted to pivot pin 112, which extends through pivot holes formed in flanges 102 and 104.

As will be described hereinbelow, a user can open and close circumferential lock 32 by pivoting lever 110 about pivot pin 112 between an up and a down position.

Figure 4:
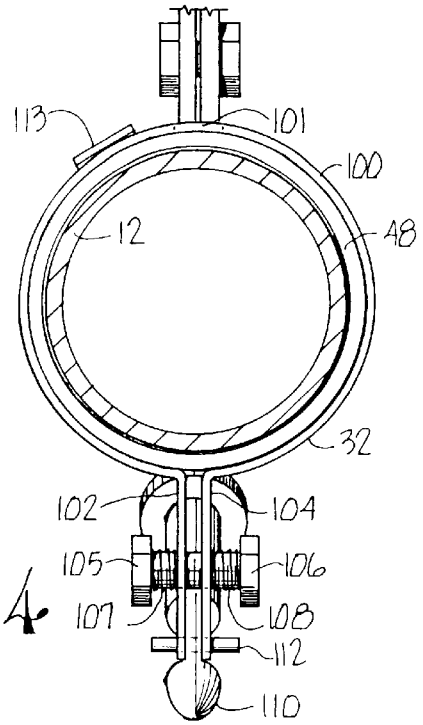
FIG. 4 is cross-sectional view of the pole, sleeve, and circumferential lock of the multi-workstation device taken along line A—A of FIG. 6, with the circumferential lock shown in the closed position.
Figure 6:
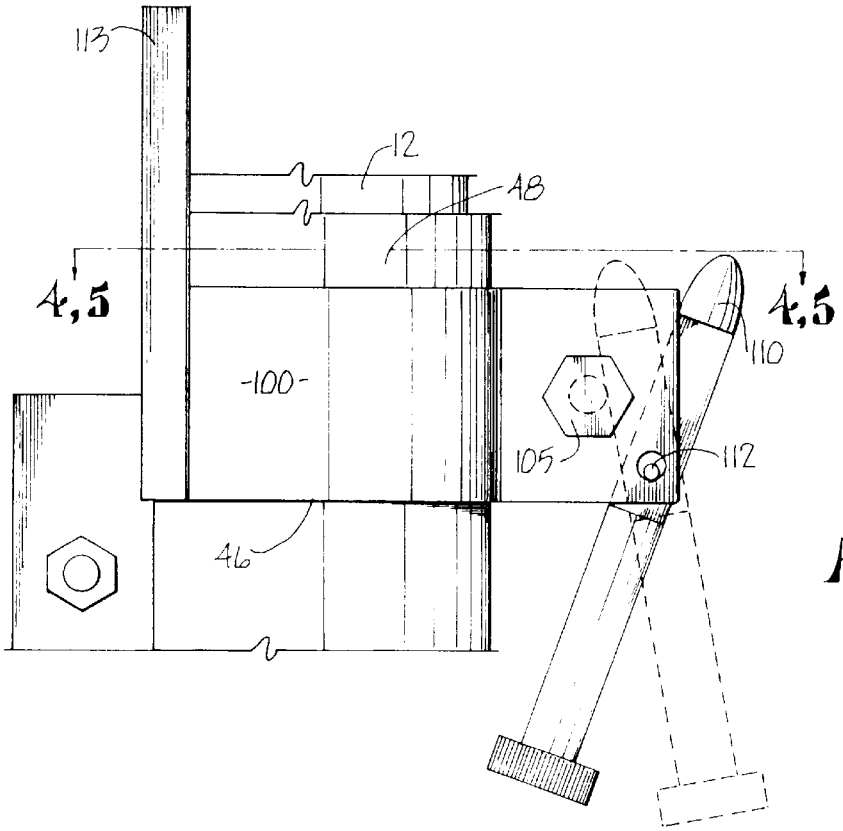
FIG. 6 is a fragmentary side view of the pole, sleeve, and circumferential lock of the multi-workstation device of FIG. 1, with the circumferential lock shown in the closed and open positions as solid and dashed lines, respectively.

Referring to FIGS. 4 and 6 (solid lines), circumferential lock 32 is illustrated in the closed position. Specifically, lever 110 is in the down position, which allows bias springs 107 and 108 to urge flanges 102 and 104 toward each other. This causes flexible strap 100 to tighten around the lower portion of sleeve 48, thereby causing sleeve 48 to fixedly engage pole 12. As such, sleeve 48 is locked in a fixed circumferential position relative to pole 12.

Figure 5:
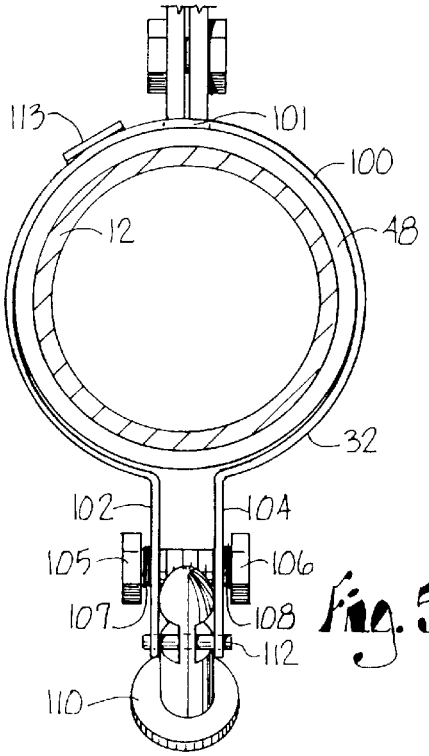
FIG. 5 is a cross-sectional view of the pole, sleeve, and circumferential lock of the multi-workstation device taken along line A—A of FIG. 6, with the circumferential lock shown in the open position.

Referring to FIGS. 5 and 6 (dashed lines), circumferential lock 32 is illustrated in the open position. Specifically, lever 110 is in the up position, which causes the tip of lever 110 to engage flanges 102 and 104 and force them away from each other, thereby compressing springs 107 and 108. This causes flexible strap 100 to release the lower portion of sleeve 48, which in turn causes sleeve 48 to disengage from pole 12. As such, sleeve 48 is free to rotate about the circumference of pole 12.

In use, a user of the tools can circumferentially lock workstation assembly 30 to pole 12 by pivoting lever 110 to the down position, thereby allowing the user to work with a first tool. If the user needs to work with a second tool, he can pivot lever 110 to the up position and rotate workstation assembly 30 about pole 12 until the second tool is in a desired circumferential position. The user can then pivot lever 110 back to the down position to circumferentially lock workstation assembly 30 to pole 12, thereby allowing the user to work with the second tool.

Referring to FIG. 3, circumferential lock 32 also includes tab 113 welded or otherwise affixed to the sidewall of strap 100. Tab 113 operates in conjunction with tab 49 to limit the circumferential rotation of workstation assembly 30. In use, the user can rotate workstation assembly 30 approximately 350° about the circumference of pole 12 until tab 49 engages tab 113. As such, the electrical cords running from the tools mounted on work surfaces 58 to power supply assembly 38 do not become tangled in use.

Seat Assembly

Figure 7:
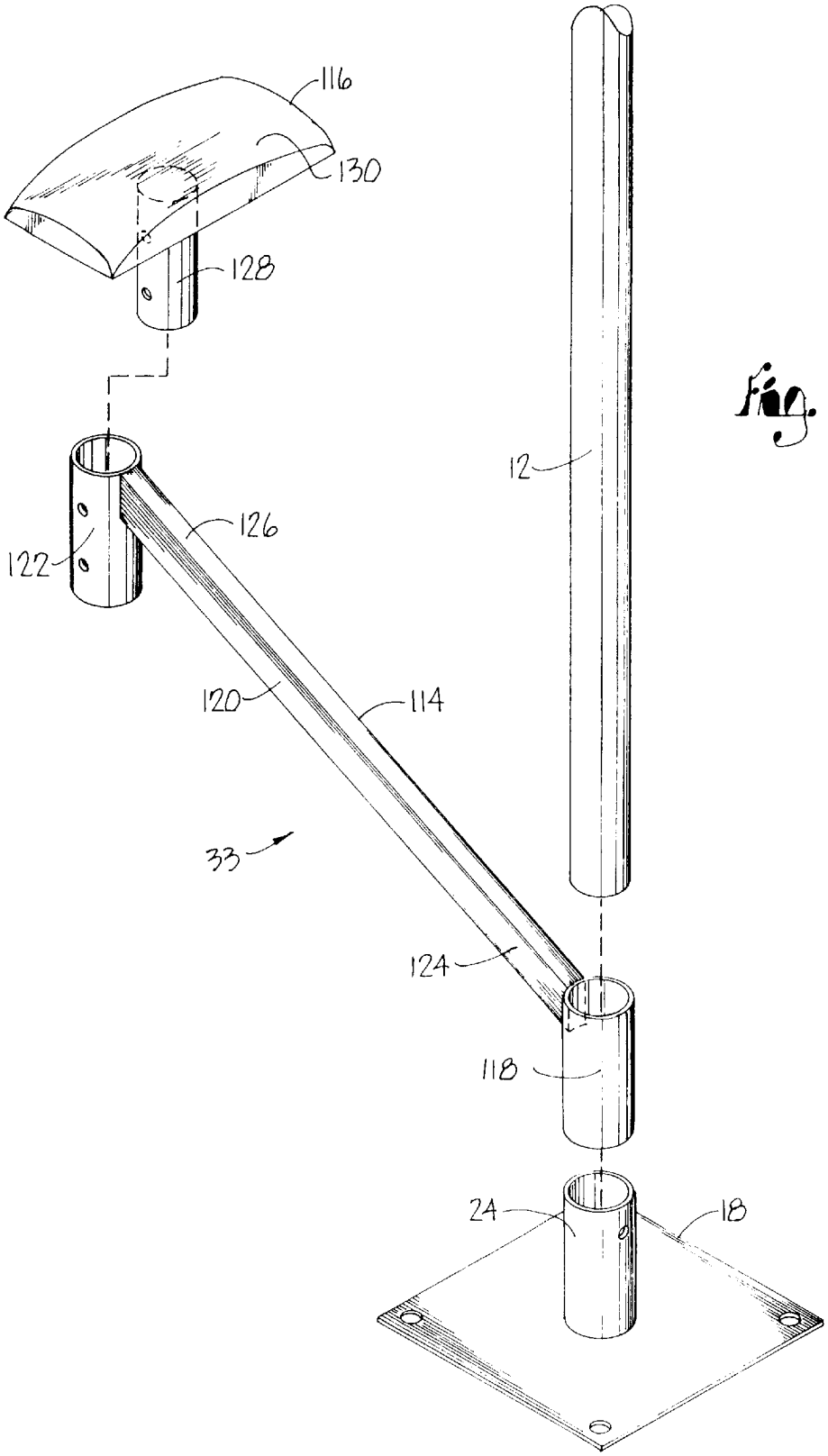
FIG. 7 is an exploded perspective view of the seat assembly of the multi-workstation device of FIG. 1.

Referring to FIG. 7, seat assembly 33 includes extension 114 rotatably mounted to pole 12, and seat 116 connected to extension 114.

Extension 114 includes first sleeve 118 mounted to pole 12, arm 120 extending angularly outward from first sleeve 118 at a first end thereof, and second sleeve 122 attached to arm 120 at a second end thereof.

First sleeve 118 has an inside diameter that is slightly larger than the outside diameter of pole 12 so that sleeve 118 can be rotatably mounted to pole 12. First sleeve 118 has an outside diameter that is substantially the same as the outside diameter of sleeve 24 so that sleeve 24 can support first sleeve 118 in a fixed vertical position.

Arm 120 includes an elongated tube having first end 124 attached to first sleeve 118 and second end 126 attached to second sleeve 122. First and second ends 124 and 126 are cut at an angle so that arm 120 extends angularly outward from first sleeve 118. As such, seat 116 can be positioned at a height that is convenient for the user.

Second sleeve 122 has an inside diameter that is slightly larger than the outside diameter of sleeve 128 so that sleeve 128 can be mounted in second sleeve 122 and bolted or otherwise connected thereto.

Seat 116 includes cushioned seat plate 130 and downwardly extending sleeve 128 centrally disposed on the bottom of seat plate 130 and welded or otherwise affixed thereto. As described above, sleeve 128 has an outside diameter that is slightly smaller than the inside diameter of second sleeve 122 so that sleeve 128 can be mounted in second sleeve 122 and bolted or otherwise connected thereto.

Light Assembly

Light assembly 34 consists of a light kit which is vertically adjustable and circumferentially rotatable relative to pole 12, as is known in the art.

Winch Assembly

Figure 8:
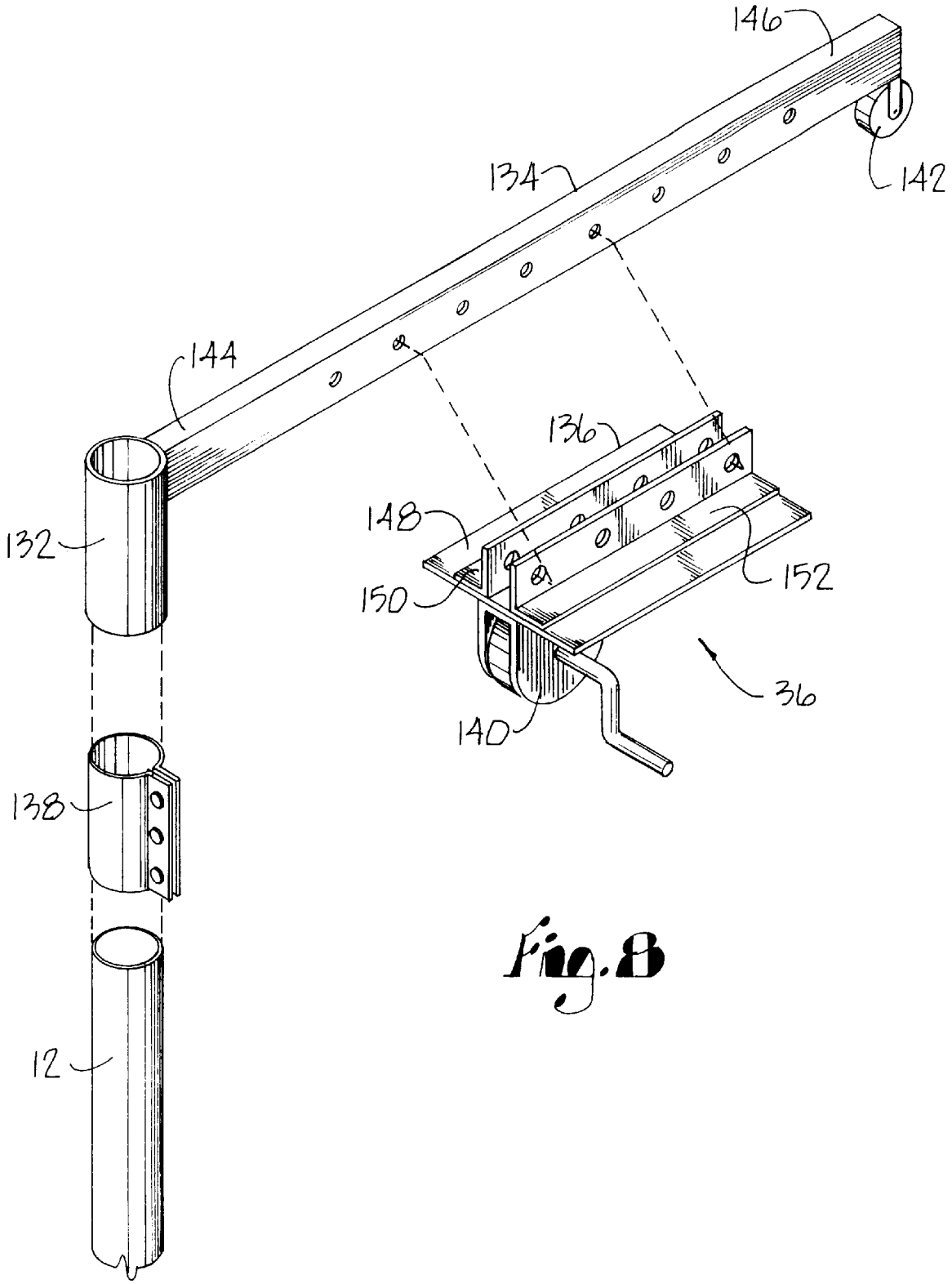
FIG. 8 is an exploded perspective view of the winch assembly of the multi-workstation device of FIG. 1.

Referring to FIG. 8, winch assembly 36 includes sleeve 132 rotatably mounted to pole 12, arm 134 extending laterally outward from sleeve 132, winch mount 136 connected to arm 134 for mounting the winch, and vertical lock 138 for locking sleeve 132 in a fixed vertical position. The winch includes first pulley 140 mounted to winch mount 136 and second pulley 142 mounted to arm 134.

Sleeve 132 has an inside diameter that is slightly larger than the outside diameter of pole 12 so that sleeve 132 can be rotatably mounted to pole 12.

Arm 134 includes an elongated tube having first end 144 welded or otherwise affixed to the sidewall of sleeve 132, and second end 146 for mounting second pulley 142 on the bottom thereof Arm 134 could also include an extension attached to second end 146 for extending the distance between second pulley 142 and pole 12.

Winch mount 136 includes horizontally oriented plate 148 for mounting first pulley 140. Plate 148 is bolted or otherwise connected to two spaced angle irons 150 and 152, wherein each angle iron consists of a horizontally oriented member and a vertically oriented member at a right angle thereto. The horizontally oriented members are bolted or otherwise connected to the top of horizontally oriented plate 148, and the vertically oriented members are bolted or otherwise connected to the sides of arm 134.

Vertical lock 138 has the same structure as vertical lock 31. In use, a user can fixedly mount vertical lock 138 to pole 12 at a position directly below sleeve 132 so that the top edge of vertical lock 138 abuts the bottom edge of sleeve 132. As such, vertical lock 138 supports sleeve 132 in a fixed vertical position. The user can also reposition vertical lock 138 anywhere along pole 12 so as to adjust the vertical position of winch assembly 36 to a desired vertical height.

Although winch assembly 36 has been described and illustrated as being rotatably mounted to pole 12, a circumferential lock could also be provided for locking sleeve 132 to pole 12 in a fixed circumferential position.

Power Supply Assembly

Referring to FIGS. 1 and 2, power supply assembly 38 includes electrical mount 160 for mounting power supply 162. Electrical mount 160 includes angle iron 164 consisting of a vertically oriented member and a horizontally oriented member at a right angle thereto. The center portion of the vertically oriented member is welded or otherwise affixed to the sidewall of sleeve 28. The horizontally oriented member is bolted or otherwise connected to power supply 162, which in turn is operably connected to a source of electrical power, such as a conventional 110 V AC wall outlet, via appropriate wiring. Preferably, the number of outlets on power supply 162 is the same as the number of tools capable of being supported by multi-workstation device 10.

Air Supply Assembly

Referring to FIG. 1, air supply assembly 40 includes air inlet 166 and air outlet 168 formed in the sidewall of pole 12 near upper end 16, and moisture release outlet 170 formed in the sidewall of pole 12 near lower end 14.

Air inlet 166 is fitted with an air inlet fitting so that it can be operably connected to a source of compressed air, such as a conventional air compressor, via appropriate air lines. Air inlet 166 is in gaseous communication with the inner air passage of pole 12, which in turn is in gaseous communication with air outlet 168. Air outlet 168 is fitted with an air outlet fitting so that it can be operably connected to a pneumatic tool, or, alternately, to an air hose which can be used to clean the electrical tools. Moisture release outlet 170 is provided to release moisture from the inner air passage of pole 12 which will accumulate due to the pressurized air flow therethrough.

Workbench Assembly

In place of seat assembly 33, multi-workstation device 10 may also optionally include a workbench assembly for providing additional work space for the user.

Referring to FIG. 9, workbench assembly 172 includes extension 174 rotatably mounted to pole 12, and workbench 176 bolted or otherwise connected to extension 174. Extension 174 has the same structure as extension 114 of seat assembly 33 described and illustrated hereinabove. Workbench 176 includes horizontal work surface 178 and downwardly extending sleeve 180 welded or otherwise affixed to the bottom corner of work surface 178. Sleeve 180 has an outside diameter that is slightly smaller than the inside diameter of second sleeve 181 so that sleeve 180 can be mounted in second sleeve 181 and bolted or otherwise connected thereto.

Although sleeve 180 has been described and illustrated as being bolted or otherwise connected to the sleeve 181, it should be understood that the bolts could also be removed so that the sleeve 180 could be pivoted within sleeve 181 to thereby fold away the workbench assembly 172 when not in use.

Second Example

Referring to FIG. 10, a second example of the multi-workstation device of the present invention is illustrated.

Multi-workstation device 181 includes vertically oriented pole 182 extending upwardly from a horizontal surface, such as a floor of a shop, and rigidly secured at lower end 184. To rigidly secure pole 182 at lower end 184, floor mount 186 is provided. Floor mount 186 has the same structure as floor mount 18 of the first example, with the exception that pyramidal base 188 is bolted or otherwise affixed to base plate 190 for mounting power supply 192. Pole 182 could also be rigidly secured to a movable base, as is known in the art.

Multi-workstation device 181 also includes workstation assembly 194 mounted to pole 182 for providing rigid surfaces on which to mount the tools. Workstation assembly 194 has the same structure as workstation assembly 30 of the first example. Workstation assembly 194 is vertically adjustable and circumferentially rotatable relative to pole 182, and, as such, device 181 also includes vertical lock 195 and circumferential lock 196, which have the same structure as vertical lock 31 and circumferential lock 32 of the first example.

Multi-workstation device 181 also includes air inlet 197 and air outlet 198 formed in the sidewall of pole 182, which have the same structure as air inlet 166 and air outlet 168 of the first example.

Although the multi-workstation device of the present invention has been described and illustrated with regard to specific examples, it should be understood that various modifications of the multi-workstation device are also possible without departing from the scope of the inventive idea of the present invention. Therefore, the present invention is not to be limited to the specific structure or arrangement of parts described and illustrated hereinabove, except insofar as such limitations are included in the following claims.

What is claimed is:

1. A multi-workstation device, comprising:

(a) a vertically-oriented pole having an upper end and a lower end;

(b) a workstation assembly mounted between said upper and lower ends of said pole, wherein said workstation assembly is vertically adjustable and circumferentially rotatable relative to said pole;

(c) a vertical lock mounted between said upper and lower ends of said pole for locking said workstation assembly to said pole in a fixed vertical position; and (d) a circumferential lock mounted between said upper and lower ends of said pole for locking said workstation assembly to said pole in a fixed circumferential position;

(e) wherein said circumferential lock is moveable between a locked and an unlocked position, wherein said workstation assembly is freely rotatable about substantially the entire circumference of said pole when said circumferential lock is in said unlocked position, and wherein said workstation assembly is locked to said pole in a fixed circumferential position when said circumferential lock is in said locked position.

2. The multi-workstation device of claim 1 wherein said workstation assembly comprises:

(a) a sleeve mounted between said upper and lower ends of said pole;

(b) a plurality of arms affixed to and extending outwardly from said sleeve; and (c) a plurality of horizontally-oriented work surfaces affixed to said plurality of arms such that said work surfaces are each positioned at substantially the same vertical position relative to said pole.

3. The multi-workstation device of claim 1 further comprising a seat assembly mounted between said upper and lower ends of said pole.

4. The multi-workstation device of claim 1 further comprising a workbench assembly mounted between said upper and lower ends of said pole.

5. The multi-workstation device of claim 1 further comprising a light assembly mounted between said upper and lower ends of said pole.

6. The multi-workstation device of claim 1 further comprising a power supply mounted to said pole and operably connected to a source of electrical power.

7. A multi-workstation device, comprising:

(a) a vertical pole having an upper end and a lower end;

(b) a workstation assembly, comprising:

(i) a sleeve mounted between said upper and lower ends of said pole, wherein said sleeve is vertically adjustable and circumferentially rotatable relative to said pole;

(ii) a plurality of arms affixed to and extending radially outward from said sleeve; and (iii) a plurality of horizontally-oriented work surfaces affixed to said plurality of arms;

(c) a vertical lock mounted to said pole at a position below said sleeve, wherein said vertical lock is vertically adjustable relative to said pole, and wherein said vertical lock supports said sleeve in a fixed vertical position;

(d) a circumferential lock mounted to said sleeve, wherein said circumferential lock is movable between an open position and a closed position, and wherein said circumferential lock locks said sleeve to said pole in a fixed circumferential position when said circumferential lock is in said closed position;

(e) a seat assembly mounted between said upper and lower ends of said pole and positioned below said workstation assembly;

(f) a light assembly mounted between said upper and lower ends of said pole and positioned above said workstations assembly;

(g) a winch assembly mounted between said upper and lower ends of said pole and positioned above said workstation assembly;

(h) a power supply mounted to said pole and operably connected to a source of electrical power; and (i) an air supply mounted to said pole and operably connected to a source of compressed air.

8. A multi-workstation device for mounting a plurality of tools, comprising:

(a) a vertically-oriented pole having an upper end and a lower end;

(b) means for mounting said plurality of tools, wherein said tool mounting means is mounted between said upper and lower ends of said pole and is vertically adjustable and circumferentially rotatable relative to said pole;

(c) means for locking said tool mounting means to said pole in a fixed vertical position, wherein said vertical locking means is mounted between said upper and lower ends of said pole;

(d) means for locking said tool mounting means to said pole in a fixed circumferential position, wherein said circumferential locking means is mounted between said upper and lower ends of said pole;

(e) a seat assembly for providing a seat for a user of said tools, wherein said seat assembly is mounted between said upper and lower ends of said pole and is positioned below said tool mounting means;

(f) a light assembly for providing a light for a user of said tools, wherein said light assembly is mounted between said upper and lower ends of said pole and is positioned above said tool mounting means;

(g) a winch assembly for assisting a user of said tools in lifting heavy objects onto said tool mounting means, wherein said winch assembly is mounted between said upper and lower ends of said pole and is positioned above said tool mounting means;

(h) a power supply for providing electrical power to said plurality of tools, wherein said power supply is mounted to said pole and is operably connected to a source of electrical power; and (i) an air supply for providing air to said tools, wherein said air supply is mounted to said pole and is operably connected to a source of compressed air.

9. A multi-workstation device, comprising:

(a) a vertically-oriented pole having an upper end and a lower end;

(b) a workstation assembly mounted between said upper and lower ends of said pole, wherein said workstation assembly is vertically adjustable and circumferentially rotatable relative to said pole;

(c) a vertical lock mounted between said upper and lower ends of said pole for locking said workstation assembly to said pole in a fixed vertical position;

(d) a circumferential lock mounted between said upper and lower ends of said pole for locking said workstation assembly to said pole in a fixed circumferential position; and (e) a winch assembly mounted between said upper and lower ends of said pole.

10. A multi-workstation device, comprising:

(a) a vertically-oriented pole having an upper end and a lower end;

(b) a workstation assembly mounted between said upper and lower ends of said pole, wherein said workstation assembly is vertically adjustable and circumferentially rotatable relative to said pole;

(c) a vertical lock mounted between said upper and lower ends of said pole for locking said workstation assembly to said pole in a fixed vertical position;

(d) a circumferential lock mounted between said upper and lower ends of said pole for locking said workstation assembly to said pole in a fixed circumferential position; and (e) an air supply mounted to said pole and operably connected to a source of compressed air.

11. A multi-workstation device, comprising:

(a) a vertically-oriented pole having an upper end and a lower end;

(b) a workstation assembly mounted between said upper and lower ends of said pole, wherein said said workstation assembly is vertically adjustable and circumferentially rotatable relative to said pole, and wherein said workstation assembly comprises:

(i) a central hub mountable along the length of said pole;

(ii) a plurality of arms affixed to and extending radially outward from said central hub;

(iii) a plurality of horizontally-oriented work surfaces affixed to said plurality of arms such that said work surfaces are each positioned at substantially the same vertical position along the length of said pole;

(c) a vertical lock mounted between said said upper and lower ends of said pole for locking said workstation assembly to said pole in a fixed vertical position; and (d) a circumferential lock mounted between said upper and lower ends of said pole for locking said workstation assembly to said pole in a fixed circumferential position.

12. The multi-workstation device of claim 11 wherein said upper end of said pole is fixedly mounted to a ceiling and said lower end of said pole is fixedly mounted to a floor.

13. The multi-workstation device of claim 11 wherein said circumferential lock operates independently of said vertical lock such that said workstation assembly can be circumferentially rotated relative to said pole without changing the vertical position of said workstation assembly.

14. The multi-workstation device of claim 1 wherein said upper end of said pole is fixedly mounted to a ceiling and said lower end of said pole is fixedly mounted to a floor.

15. A multi-workstation device, comprising:

(a) a vertically-oriented pole having an upper end fixedly mounted to a ceiling and a lower end fixedly mounted to a floor; and (b) a workstation assembly mounted between said upper and lower ends of said pole, wherein said said workstation assembly is vertically adjustable and circumferentially rotatable relative to said pole, and wherein said workstation assembly comprises:

(i) a central hub mountable along the length of said pole;

(ii) a plurality of arms affixed to and extending radially outward from said central hub;

(iii) a plurality of horizontally-oriented work surfaces affixed to said plurality of arms such that said work surfaces are each positioned at substantially the same vertical position along the length of said pole.

* * * * *

UNITED STATES PATENT AND TRADEMARK OFFICE

CERTIFICATE OF CORRECTION

PATENT NO : 5,906,284

DATED : May 25, 1999

INVENTOR(S): Hammerstrom et al.

It is certified that error appears in the above-identified patent and that said Letters Patent is hereby corrected as shown below:

In column 2, lines 44 and 49, change "A-A" to
-- 4,5-4,5 --.

In column 6, line 29, of the Patent, add "." between "thereof" and "Arm."

Signed and Sealed this

Eighteenth Day of January, 2000

*Attest:*

Q. TODD DICKINSON

*Attesting Officer*

*Commissioner of Patents and Trademarks*